US007865999B2

(12) United States Patent
Hilger

(10) Patent No.: US 7,865,999 B2
(45) Date of Patent: Jan. 11, 2011

(54) DOOR MOTION CONTROLLER ASSEMBLY

(75) Inventor: Timothy J. Hilger, LaGrange Park, IL (US)

(73) Assignee: Yale Security Inc., Monroe, NC (US)

( * ) Notice: Subject to any disclaimer, the term of this patent is extended or adjusted under 35 U.S.C. 154(b) by 800 days.

(21) Appl. No.: 11/670,746

(22) Filed: Feb. 2, 2007

(65) Prior Publication Data

US 2008/0184627 A1 Aug. 7, 2008

(51) Int. Cl.
*E05F 3/00* (2006.01)

(52) U.S. Cl. ..... 16/65; 16/49; 16/72; 16/85; 16/DIG. 10

(58) Field of Classification Search ..... 16/49, 16/63–65, 71, 78–80, 72, 82, 85, DIG. 17, 16/DIG. 10; 292/DIG. 19; 49/371, 386, 49/414

See application file for complete search history.

(56) References Cited

U.S. PATENT DOCUMENTS

| | | | | | |
|---|---|---|---|---|---|
| 2,958,089 | A | | 11/1960 | Roehm et al. | |
| 3,220,046 | A | * | 11/1965 | Flint | 16/59 |
| 3,699,608 | A | * | 10/1972 | Schwarz | 16/79 |
| 3,763,519 | A | | 10/1973 | Favre | |
| 3,852,846 | A | * | 12/1974 | Slaybaugh | 16/48.5 |
| 3,875,612 | A | * | 4/1975 | Poitras | 16/48.5 |
| 3,996,642 | A | | 12/1976 | Atkins | |
| 4,073,033 | A | * | 2/1978 | Lexnas | 16/52 |
| 4,564,973 | A | | 1/1986 | Kordes | |
| 4,750,236 | A | * | 6/1988 | Teague, Jr. | 16/49 |
| 4,751,766 | A | | 6/1988 | Fahs et al. | |
| 4,979,261 | A | * | 12/1990 | Lasier et al. | 16/62 |
| 5,088,152 | A | * | 2/1992 | Downey | 16/80 |
| 5,309,676 | A | * | 5/1994 | Appelmann et al. | 49/253 |
| 5,381,628 | A | | 1/1995 | D'Hooge | |
| 5,448,797 | A | | 9/1995 | Coleman | |
| 5,448,798 | A | | 9/1995 | Coleman et al. | |
| 5,495,639 | A | | 3/1996 | Wartian | |
| 5,513,467 | A | * | 5/1996 | Current et al. | 49/340 |
| 6,151,753 | A | * | 11/2000 | Salutzki | 16/62 |
| 6,223,469 | B1 | * | 5/2001 | Moll | 49/341 |

(Continued)

OTHER PUBLICATIONS

"No. 1 Series Concealed Door Stops and Holders", http://www.assaabloydss.com/library/installation_instructions/RIXSON/pdf/OH80000A%2Epdf, visited Jul. 23, 2006, 1 page.

(Continued)

*Primary Examiner*—William L. Miller
(74) *Attorney, Agent, or Firm*—Matthew W. Witsil; Moore & Van Allen PLLC

(57) ABSTRACT

A track and arm type door controller assembly. A channel member and a gripping member each having a toothed surface are provided, with the gripping member slidably disposed in the channel member. When the pin is retracted, the gripping member teeth are spaced from the channel member teeth, and the gripping member may freely slide along the track. When the pin is advanced, the teeth engage and the gripping member is in a fixed, non-sliding position. An elongated spring and a spring clip or a latch may be provided that releasably engage to hold the door open. A set screw may adjust the tightness of the engagement of the elongated spring and spring clip of latch. A friction assembly may be provided to slow the motion of the door.

28 Claims, 9 Drawing Sheets

U.S. PATENT DOCUMENTS

| | | | | |
|---|---|---|---|---|
| 6,253,417 | B1 | 7/2001 | Rusiana | |
| 6,262,548 | B1 * | 7/2001 | Scholten et al. | 318/445 |
| 6,421,876 | B1 * | 7/2002 | Ginzel et al. | 16/79 |
| 6,510,586 | B1 * | 1/2003 | Ginzel | 16/79 |
| 7,444,713 | B2 * | 11/2008 | McKinney et al. | 16/63 |
| 2004/0205930 | A1 * | 10/2004 | Huang | 16/64 |
| 2004/0205931 | A1 | 10/2004 | Huang | |
| 2005/0246860 | A1 | 11/2005 | Huang | |

OTHER PUBLICATIONS

"Checkmate Stops & Holders Auxiliary Door Control for Wall and Door Protection", http://www.assaabloydss.com/library/catalogs/RIXSON/pdf/RC_Checkmate%20Stop%Holders.pdf, Visited Jul. 23, 2006, cover, pp. 150-166.

* cited by examiner

DOOR MOTION CONTROLLER ASSEMBLY

BACKGROUND

The present invention relates to the field of door hardware, and more particularly concerns track and arm holder assemblies for doors.

Door motion controllers include track and arm door holder assemblies. Track and arm door holder assemblies are often used to hold open doors that have automatic door closers. An automatic door closer applies force to the door to push the door to the closed position. A door holder assembly holds the door open when the door is opened past a certain threshold point. The door holder must overcome the force exerted by the closer, and then release when additional force is provided to close the door.

A track and arm door holder includes a track assembly and an arm assembly. The track assembly attaches to the top of each door, either on the surface of the door or in a recessed area in the top edge of the door. The arm assembly is attached between the door frame header and the track assembly. An end of the arm assembly attaches to a sliding mechanism movably disposed in the track assembly. A trip lever holds the door open at a precise location which may be, for example, 85, 90, 95, 100, 105, or 110 degrees open. Such an arrangement requires the track assembly and the arm assembly to be mounted in precise locations in order to fix the desired angle of opening, and frequently the assembly cannot be adjusted once the mounting is performed.

Attempts have been made to provide an adjustable hold-open mechanism for a door holder assembly. Current designs may include an expandable block with a set screw that is lodged between the walls of the track, which may be a "C" shaped channel. The expandable block relies largely on friction to fix its position, but the momentum of doors that may weigh on the order of two to three hundred pounds can dislodge this type of device. The relatively low holding strength of the block and premature wear of the channel that can result from the friction action may cause poor performance.

There are also door motion controllers that slow the motion of the door as the door approaches the fully open position and as the door begins to return to the closed position. In this arrangement, the sliding mechanism of the track assembly may include a friction assembly with a surface that rubs along a raised portion of the track at the end of the mechanism's motion. A stop determines the fully open position of the door. However, the stop frequently cannot be adjusted within the track, must be carefully placed during installation to locate the fully open position as desired.

Accordingly, there exists a need for a new door controller assembly. Ideally, the new door controller assembly will be adjustable to allow door holding over a range of opening angles and provide holding strength to prevent movement of the door from the holding position.

SUMMARY

In accordance with an embodiment of the present invention, a door motion controller assembly is provided for a door. The door includes a first major surface and a second major surface, and a hinged vertical edge, a free vertical edge, a top edge, and a bottom edge. The edges are between and interconnect the first major surface and the second major surface. The motion controller assembly includes an elongated channel member and a gripping member. The elongated channel member has a longitudinal axis and includes a web and two side walls extending in the same direction from the web, and defines an elongated channel. The channel member further includes teeth extending from a side of the web and into the channel, and is adapted to be mounted to the door. The gripping member includes a toothed surface and is slidably disposed in the channel member such that the toothed surface opposes the toothed side of the web. The gripping member has a first position spaced from the channel member teeth such that the gripping member is movable in the channel member, and a second position where the teeth of the gripping member engage the channel member teeth such that the gripping member is fixed relative to the channel member.

In accordance with another embodiment according to the present invention, a motion controller assembly for a door includes an elongated channel member having a longitudinal axis and including a web and two side walls extending in the same direction from the web, defining an elongated channel. The channel member further includes teeth extending from a side of the web and into the channel, and is adapted to be mounted to the door. A gripping member is slidably disposed in the channel member and includes a housing slidably disposed in the channel member and having a threaded opening opposite the channel member teeth, a toothed portion that is movably disposed in the housing with teeth that oppose the channel member teeth, and a pin including a first threaded end engaging the threaded opening of the housing and including a second end rotatably mounted to the toothed portion. An elongated clip is mounted to the gripping member, extends along the longitudinal axis, and includes a deformed end. A slide piece is slidably disposed in the channel member and is spaced from the housing. A spring clip or a latch is mounted to the slide piece. The toothed portion has a first position spaced from the channel member teeth such that the gripping member is movable in the channel member when the pin is retracted, and a second position where the teeth of the toothed portion engage the channel member teeth such that the gripping member is fixed relative to the channel member when the pin is advanced. When the spring clip or latch slides towards the gripping member, the spring clip or latch engages the deformed end of the elongated clip.

In accordance with another embodiment of the present invention, a motion controller assembly for a door includes an elongated channel member having a longitudinal axis and including a web and two side walls extending in the same direction from the web, defining an elongated channel. The channel member further includes teeth extending from a side of the web and into the channel, and is adapted to be mounted to the door. A gripping member is slidably disposed in the channel member and includes a housing slidably disposed in the channel member and having a threaded opening opposite the channel member teeth, a toothed portion that is movably disposed in the housing with teeth that oppose the channel member teeth, and a pin including a first threaded end engaging the threaded opening of the housing and including a second end rotatably mounted to the toothed portion. An elongated clip is mounted to the gripping member and extends along the longitudinal axis. The elongated clip includes a deformed end. A slide piece is slidably disposed in the channel member, is spaced from the housing, and has a threaded opening. A spring clip is mounted to the slide piece. A set screw extends through and engages the threaded opening in the slide piece. When the slide piece slides towards the housing, the spring clip and the deformed end of the elongated clip releasably engage, and when advanced the set screw urges the spring clip towards the web and increases the tightness of the engagement between the spring clip and the deformed end of the elongated clip.

In accordance with another embodiment according to the present invention, a motion controller assembly for a door includes an elongated channel member having a longitudinal axis and including a web and two side walls extending in the same direction from the web, defining an elongated channel. The channel member further includes teeth extending from a side of the web and into the channel, and is adapted to be mounted to the door. A gripping member is slidably disposed in the channel member and includes a housing slidably disposed in the channel member and having a threaded opening opposite the channel member teeth, a toothed portion that is movably disposed in the housing with teeth that oppose the channel member teeth, and a pin including a first threaded end engaging the threaded opening of the housing and including a second end rotatably mounted to the toothed portion. An elongated clip is mounted to the gripping member and extends along the longitudinal axis, and includes a deformed end. A slide piece is slidably disposed in the channel member, is spaced from the housing, and has a threaded opening. A latch is pivotally mounted to the slide piece, and a set screw extends through and engages the threaded opening in the slide piece. When the slide piece slides towards the housing, the latch and the elongated clip releasably engage, and when advanced the set screw limits the pivoting of the latch and controls the tightness of the engagement between the latch and the deformed end of the elongated clip.

In accordance with another embodiment according to the present invention, a motion controller assembly for a door includes an elongated channel member having a longitudinal axis and including a web and two side walls extending in the same direction from the web, defining an elongated channel. The channel member further includes teeth extending from a side of the web and into the channel, and is adapted to be mounted to the door. A gripping member is slidably disposed in the channel member and includes a housing slidably disposed in the channel member and having a threaded opening opposite the channel member teeth, a toothed portion that is movably disposed in the housing with teeth that oppose the channel member teeth, and a pin including a first threaded end engaging the threaded opening of the housing and including a second end rotatably mounted to the toothed portion. An elongated clip is mounted to the gripping member and extends along the longitudinal axis, and includes a deformed end. A slide piece is slidably disposed in the channel member and is spaced from the housing. A friction member mounted to the slide piece. The toothed portion has a first position spaced from the channel member teeth such that the gripping member is movable in the channel member when the pin is retracted, and a second position where the teeth of the toothed portion engage the channel member teeth such that the gripping member is fixed relative to the channel member when the pin is advanced. A major surface of the friction member contacts the channel member teeth.

In accordance with another embodiment of the present invention, a door assembly includes a door and a motion controller assembly mounted to the door. The motion controller assembly includes an elongated channel member and a gripping member. The elongated channel member has a longitudinal axis and includes a web and two side walls extending in the same direction from the web, and defines an elongated channel. The channel member further includes teeth extending from a side of the web and into the channel, and is adapted to be mounted to the door. The gripping member includes a toothed surface and is slidably disposed in the channel member such that the toothed surface opposes the toothed side of the web. The gripping member has a first position spaced from the channel member teeth such that the gripping member is movable in the channel member, and a second position where the teeth of the gripping member engage the channel member teeth such that the gripping member is fixed relative to the channel member.

In accordance with another embodiment of the present invention, a method of making a motion controller assembly for a door is provided. The method includes providing an elongated channel member having a longitudinal axis and including a web and two side walls extending in the same direction from the web and defining an elongated channel. The channel member further includes teeth extending from a side of the web and into the channel, and is adapted to be mounted to the door. A gripping member is provided including a toothed portion. The gripping member is slidably disposed in the channel member such that the toothed portion of the gripping member opposes the channel member teeth.

In accordance with another embodiment of the present invention, a method of installing a motion controller assembly for a door is provided. The method includes mounting a track assembly to the door. The track assembly includes an elongated channel member having a longitudinal axis and including a web and two side walls extending in the same direction from the web, defining an elongated channel. The channel member further includes teeth extending from a side of the web and into the channel, and is adapted to be mounted to the door. A gripping member is slidably disposed in the channel member and includes a housing slidably disposed in the channel member and having a threaded opening opposite the channel member teeth, a toothed portion that is movably disposed in the housing with teeth that oppose the channel member teeth, and a pin including a first threaded end engaging the threaded opening of the housing and including a second end rotatably mounted to the toothed portion. The position of the gripping member is adjusted by sliding the gripping member along the channel member. The pin is advanced to cause the teeth of the gripping member to engage the channel member teeth, fixing the position of the housing.

In accordance with another embodiment of the present invention, a method of installing a holder assembly for a door is provided. The method includes mounting a track assembly to the door, with the track assembly including an elongated channel member, a housing, an elongated clip, a slide piece, a spring clip, and a set screw. The channel member has a longitudinal axis and includes a web and two side walls extending in the same direction from the web. The housing is slidably disposed in the channel member. The elongated clip is mounted to the housing and extends along the longitudinal axis, and includes a deformed end. The slide piece is movably disposed in the channel member, is spaced from the housing, and has a threaded opening. The spring clip is mounted to the slide piece. The set screw extends through and engages the threaded opening in the slide piece. The set screw is advanced to urge the spring clip towards the web, increasing the tightness of the engagement between the spring clip and the deformed end of the elongated clip.

In accordance with another embodiment of the present invention, a method of installing a holder assembly for a door is provided. The method includes mounting a track assembly to the door, with the track assembly including an elongated channel member, a housing, an elongated clip, a slide piece, a latch, and a set screw. The channel member has a longitudinal axis and includes a web and two side walls extending in the same direction from the web. The housing is slidably disposed in the channel member. The elongated clip is mounted to the housing and extends along the longitudinal axis, and includes a deformed end. The slide piece is movably disposed in the channel member, is spaced from the housing, and has a threaded opening. The latch is pivotally mounted to the slide piece. The set screw extends through and engages the threaded opening in the slide piece. The set screw is advanced to limit the pivoting of the latch and control the tightness of the engagement between the latch and the deformed end of the elongated clip.

Features and advantages of the present invention will become more apparent in light of the following detailed description of some embodiments thereof, as illustrated in the accompanying figures. As will be realized, the invention is capable of modifications in various respects, all without departing from the invention. Accordingly, the drawings and the description are to be regarded as illustrative in nature, and not as restrictive.

DESCRIPTION

Figure 1:
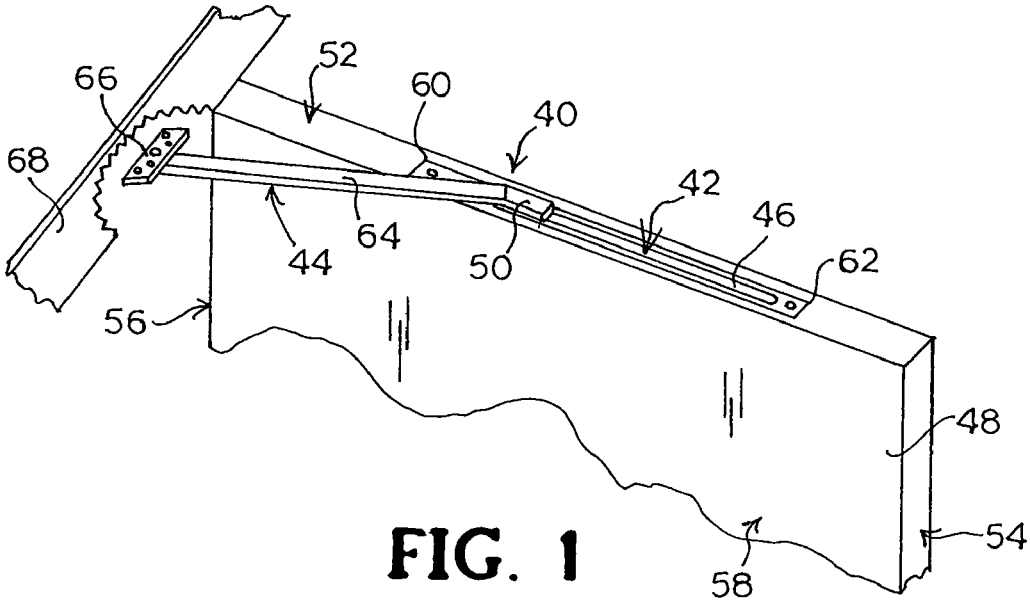
FIG. 1 is a perspective view of an embodiment of a door motion controller assembly according to the present invention.

In the Figures herein, unique features receive unique reference numerals, while features that are the same in more than one drawing receive the same reference numerals throughout. Where a feature is modified between figures or is modified only by a change in location, a letter may be added or changed after the feature reference numeral to distinguish that feature from a similar feature in a previous figure or the same feature in an alternate location. Further, certain terms of orientation may be used, such as "horizontal," "vertical," "upper," "lower," "top," "bottom," "left," "right," "inside," "outside," "inner," and "outer." These terms are generally for convenience of reference, and should be so understood unless a particular embodiment requires otherwise. Where the terms "horizontal" and "vertical" are used, they should be understood to mean "approximately horizontal" and "approximately vertical," respectively.

The scope of the invention is not intended to be limited by specific materials, but may be carried out using any materials that allow construction and operation. Materials and dimensions depend on the particular application. In general the materials of the components may be metal, and selectively may be plastic, as known by one of ordinary skill in the art.

Referring now to the drawings, an embodiment of a door motion controller assembly 40 according to the present invention is shown in FIG. 1. The door 48 has a top edge 52, a free edge 54, a hinged edge 56, a first major surface 58, and a second major surface (not shown) on the opposite side of the door 48 from the first major surface 58. The door motion controller assembly 40 includes a track assembly 42 and an arm assembly 44. The track assembly 42 includes a channel member 46 mounted in a recess in the top edge 52 of the door 48 with a sliding piece 50 disposed in the channel member 46. One end 60 of the channel 46 is proximate to the hinged edge 56 of the door 48 and the other end 62 of the channel 46 is proximate to the free edge 54 of the door 48.

The arm assembly 44 includes an arm 64 and a mounting plate 66. The mounting plate 66 is mounted to the door frame 68. The arm 64 has one end pivotally mounted to the sliding piece 50 of the track assembly 42 and one end pivotally mounted to the mounting plate 66.

Figure 2:
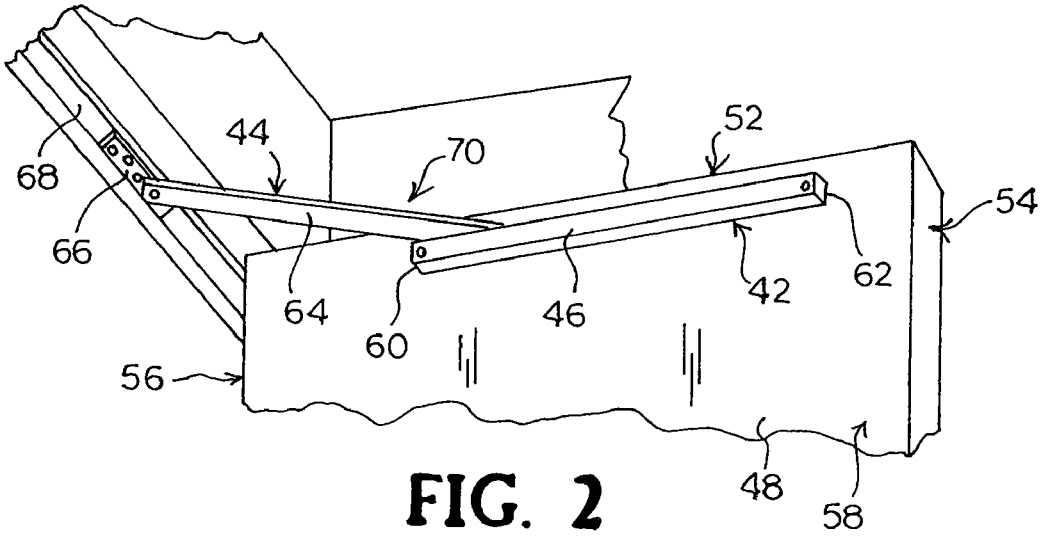
FIG. 2 is a perspective view of another embodiment of a door motion controller assembly according to the present invention.

FIG. 2 shows another embodiment of an installed door motion controller assembly 70 according to the present invention. In this configuration, the door motion controller 70 includes a surface mounted track assembly 42 is otherwise similar to the door motion controller assembly of FIG. 1.

Figure 3:
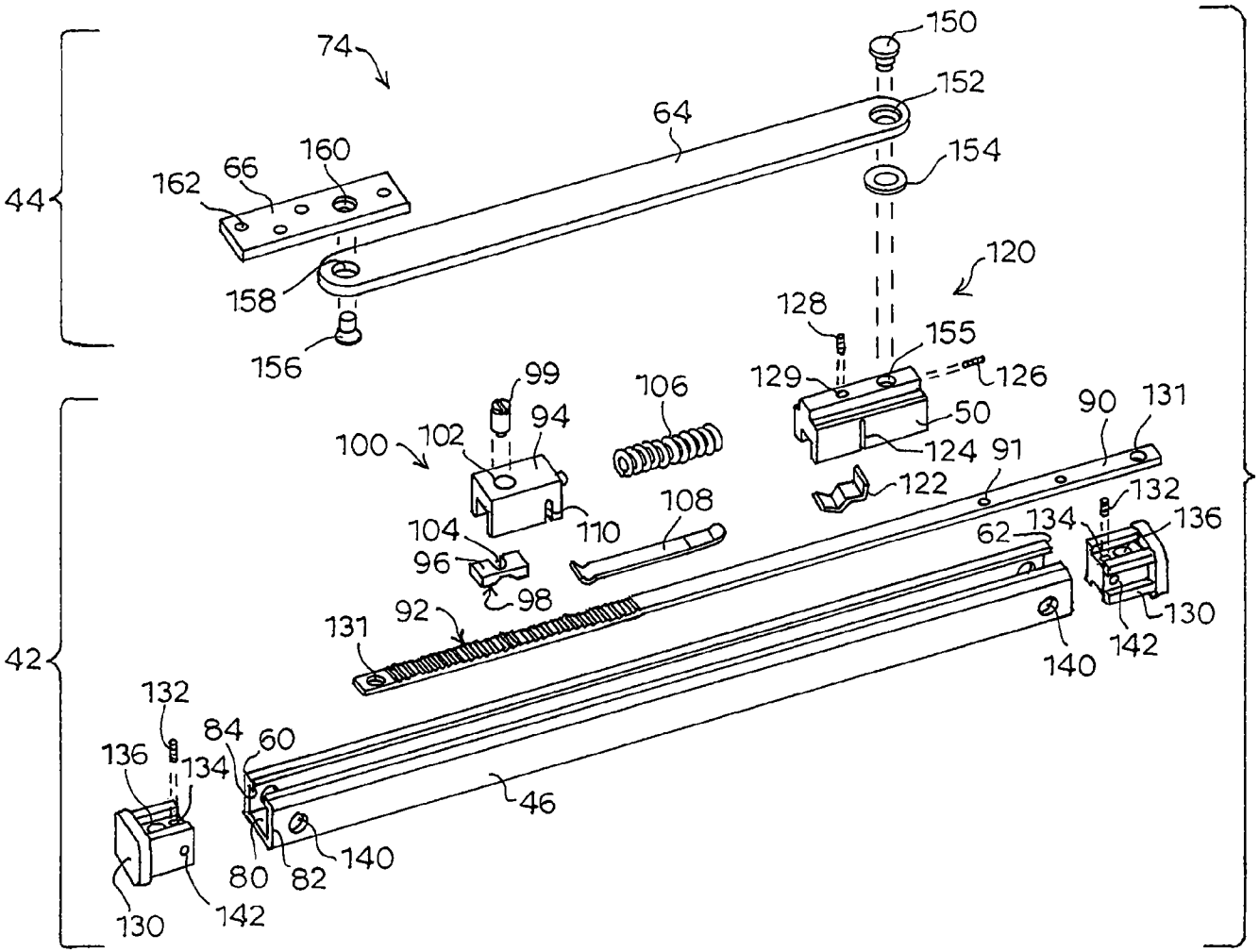
FIG. 3 is an exploded perspective view of an embodiment of a door holder assembly in the concealed configuration of the door motion controller assembly of FIG. 1.
Figure 4:
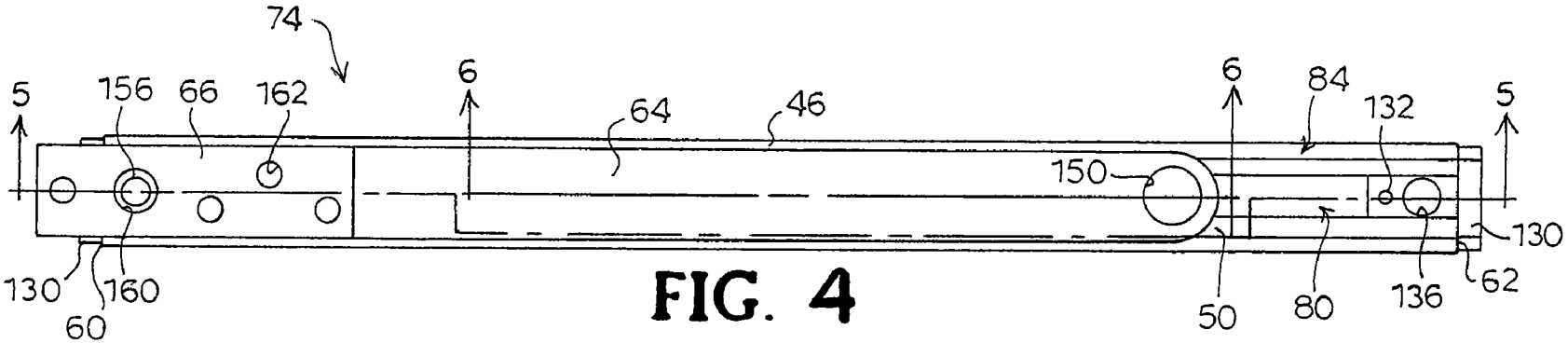
FIG. 4 is a top plan view of the door holder assembly of FIG. 3 in a first position.
Figure 5:
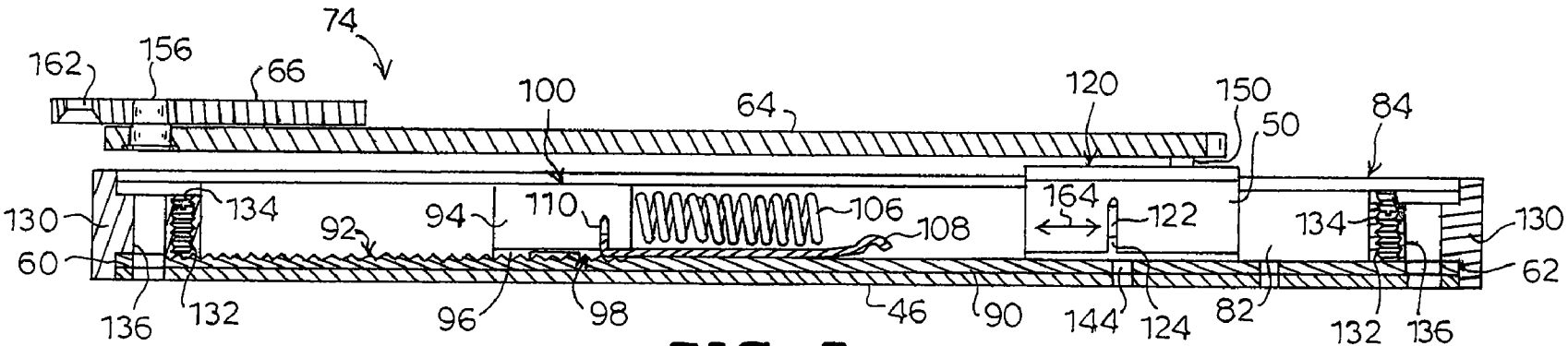
FIG. 5 is a partial section view of the door holder assembly of FIG. 3 taken along line 5-5 of FIG. 4.

FIGS. 3-5 show a door holder assembly 74 that is an embodiment of the door motion controller assemblies 40, 70 described above. The channel 46 is "C" shaped and includes a web 80, two side walls 82 extending in the same direction perpendicularly from the web 80, and two lips 84 along the side walls 82 that extend inward towards each other.

Parts that complete the track assembly 42 go inside the channel 46. A track 90 is fastened to the web 80. The track 90 includes a section that has teeth 92 on the upward side, away from the web 80. An adjustable stop 100 is slidably disposed in the channel member 46 on the track 90. The adjustable stop 100 includes a slide lock housing 94, a slide lock 96, and a slotted pin 99. Openings 90, 91 in the track may be used to fasten the track 90 to the web 80. The slidelock housing 94 is generally "U" shaped in cross-section including a base portion and opposed parallel leg portions. The track 90 is received between the leg portions. A slidelock 96 is disposed on the track 90 and at least partly within the slidelock housing 94. The slidelock 96 has teeth 98 on its bottom side proximate to the teeth 92 on the track 90 and in one embodiment is a machined plate or block. A slotted pin 99 extends through a threaded opening 102 in the housing 94 to a slot 104 in the slidelock 96 for control of the slidelock 96. A coil spring 106 is mounted to one end of the housing 94 and extends towards the end 62 of the channel 46. An elongated lock clip 108 is mounted to the bottom of the housing 94 in a slot 110 and also extends towards the end of the channel 46.

A first embodiment of a slide mechanism 120 is slibably disposed in the channel 46 between the adjustable stop 100 and end 62. The slide mechanism 120 includes the slide piece 50, a spring clip 122 and first and second set screws 126, 128. The spring clip 122 is mounted to the slide piece 50 in a slot 124 and is held into place with the first set screw 126. The second set screw 128, oriented vertically, passes through the slide piece 50 through an opening 129 to contact the spring clip 122.

End blocks 130 enclose the ends of the channel 46. Set screws 132 pass through openings 134 in the end blocks 130 and apply pressure to the track 90 to hold the track in place. Openings, not visible, through the channel web 80, openings 136 through the end blocks 130, and openings 131 through the track 90 receive fasteners for securing the channel member 46 in the recess at the top edge 52 of the door 48 for a concealed track assembly installation. If the track assembly 42 is to be mounted on the surface 58 of the door 48, openings 140 for fasteners may be provided through the side walls 82 of the channel 46 resulting a surface mounted track assembly installation as shown in the embodiment of FIG. 2. Openings 142 may be provided in the end blocks 130 to accept the set screws 132 when the end blocks 130 are rotated ninety degrees for a surface mounted door holder.

With respect to the arm assembly 44, a cam pivot 150, which is a shouldered rivet, passes through an opening 152 at one end of the arm 64, then through a washer 154 and attaches to the slide piece 50, in an opening 155, and is spun riveted in place. At the other end of the arm 64, another cam pivot 156 extends through an opening 158 in the arm 64 and into an opening 160 in the mounting plate 66 where it attaches to the mounting plate 66. Smaller openings 162 in the mounting plate 66 are used to fasten the mounting plate 66 to the door frame 68.

FIGS. 4, 5, 6, and 7 show the door holder assembly 74 in a concealed installation and in a position that is not a hold-open position. The arm 64 is shown aligned with the channel 46 for illustration purposes. The top plan view of FIG. 4 shows the arm 64, the channel member 46, the mounting plate 66, the end of the slide piece 50, the cam pivot 150 connected to the slide piece 50, the cam pivot 156 connected to the mounting plate 66, and the openings 160, 162 through the mounting plate 66. End blocks 130 are at each end of the channel member 46, with openings 134 through the end blocks 130 for set screws 132 to secure the end blocks 130 in place.

As shown in FIG. 5, the slidelock housing 94 is disposed in the channel member 46. Three components are mounted to the slidelock housing 94: the slidelock 96, the coil spring 106 and the lock clip 108. The slidelock 96 extends from the bottom of the housing 94 and is shown in a fixed position with its teeth 98 meshing with the teeth 92 of the track 90. The coil spring 106 is mounted to the right side of the housing 94 (as seen in FIG. 5) around a protrusion 95, and is uncompressed with a free end extending towards the slide piece 50. The left, bent end of the lock clip 108 is mounted to the housing 94 in a slot 110 in the slidelock housing 94. The position of the slidelock 96 determines the degree of opening of the door 48 at which the holder 40 engages. The slide piece 50 is also disposed in the channel member 46, and includes a slot 124 in which the right, bent end of the spring clip 122 (shown in FIGS. 6 and 7) is located. The slide piece 50 slides 164 relative to the channel 46 with the movement of the end of the arm 64 to which the slide piece 50 is mounted.

Figure 6:
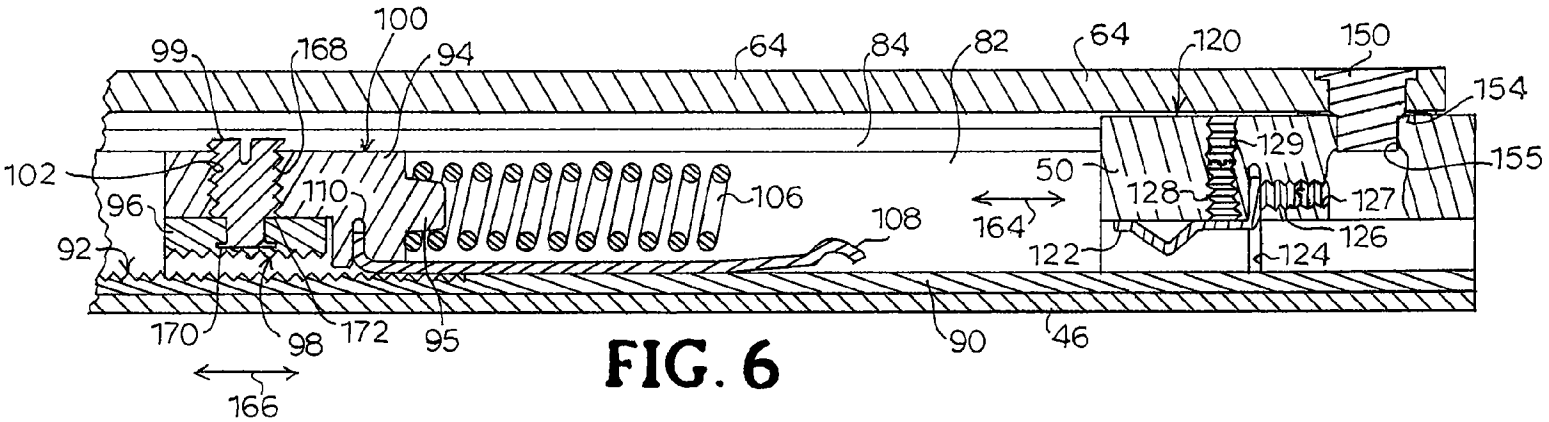
FIG. 6 is a section view of the door holder assembly of FIG. 3 in adjustable mode and in a first position taken along line 6-6 of FIG. 4.
Figure 7:
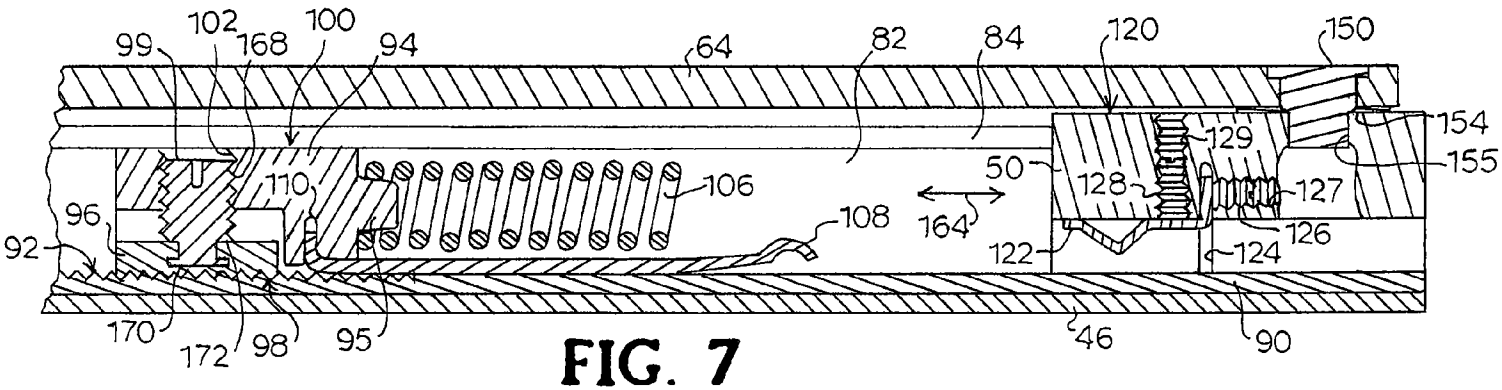
FIG. 7 is a section view of the door holder assembly of FIG. 6 in fixed mode and in a first position taken along line 6-6 of FIG. 4.

Referring now to FIGS. 6 and 7, adjustment and securing of the slidelock 96 will be described. In FIG. 6, the slidelock housing 94 is in a free movement mode and can slide horizontally, as indicated by arrow 166, along the track 90 carrying the slidelock 96. The pin 99 through the slidelock housing 94 and the slidelock 96 controls the vertical position of the slidelock 96 relative to the housing 94. The pin 99 is threaded on its upper portion 168, located in the threaded opening 102 in the housing 94, and has a lip 170 at the bottom that secured the pin 99 to the slidelock 96. The pin 99 may be positioned in and removed from the slidelock 96 by sliding in the slot 104. Rotation of the threaded pin 99 lifts the slidelock 96 when the pin 99 is in an upward position as shown. The teeth 98 of the slidelock 96 are disengaged from the teeth 92 of the track 90, permitting adjustment of to a desired set horizontal position within the channel.

The securing and adjustment of the spring clip 122 is also shown in FIGS. 6 and 7. The spring clip 122 is secured in the slot 124 by the horizontal set screw 126 in an opening 127 in the slide piece 50. The vertical set screw 128 through the vertical opening 129 in the slide piece 50 is in contact with the spring clip 122, and may be tightened to press the spring clip 122 downward, increasing the force the spring clip 122 will apply to pass over the lock clip 108 as discussed below, and consequently will increase the force required to overcome the force that must be applied to engage or disengage the lock clip 108 and spring clip 122, and thus cause the door 48 to engage and release the concealed holder 74.

In FIG. 7 the slidelock housing 94 is in a fixed position. This occurs by advancing the pin 99 into the slidelock housing 94. The slidelock 96 is lowered and then is pressed downward by the shoulder 172 of the pin 99 so that the slidelock teeth 98 mate with the track teeth 92. As the pin 99 is advanced, the housing 94 is forced upward until it is biased against the lips 84 of the channel 46. The housing 94 thus bears against the top of the channel 46, and the resulting downward force is applied to the slidelock teeth 98. The mated teeth 92, 98 provide resisting force to hold the slidelock housing 94 in place, preventing sliding of the slidelock 96 and the slidelock housing 94 along the track 90. The slidelock housing 94 and slidelock 96 positions are set based on the desired degree of opening of the door 48, as described below.

Figure 8:
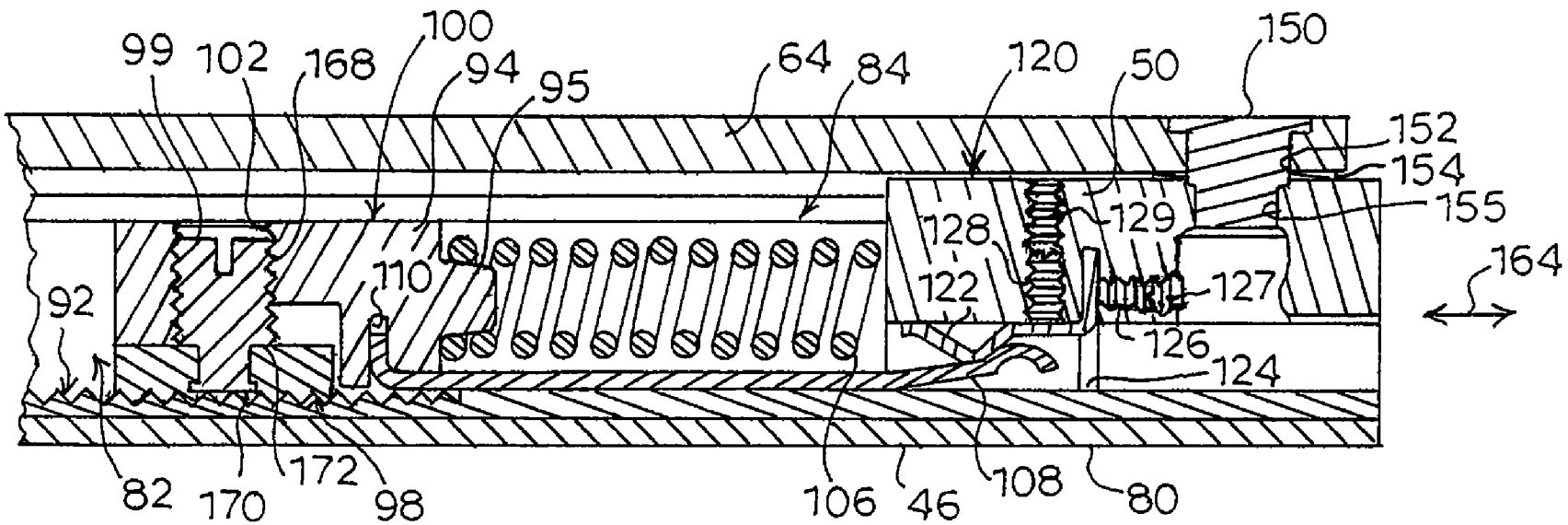
FIG. 8 is a section view of a portion of the door holder assembly of FIG. 3 in a second position.

The lock clip 108 and the spring clip 122 are separated when not in a hold-open position. When the slide piece 50 is moved by opening the door 48, the arm 64 is extended to the left (as seen in FIGS. 6-8), causing the slide piece 50 to move to the left. Consequently the spring clip 122 moves to the left past the desired and set hold-open point, as determined by the location of the right end of the lock clip 108, with a force adequate to depress one or both of the clips 108, 122. The spring clip 122 and the lock clip 108, 122 engage as shown in FIG. 8. The end of the lock clip 108 is curved and concave down, while the end of the spring clip 122 is bent more at an angle and is concave up, permitting the clips 108, 122 to releasably latch when they cross each other. As seen in FIG. 8, the slide piece 50 may abut and compress the coil spring 106, which absorbs the force of the door 48 when the door 48 carries past the hold-open point. To release the door holder 74, a force is applied to the door 48 that overcomes the force required to depress one or both of the clips 108, 122 and then disengage them.

Figure 9:
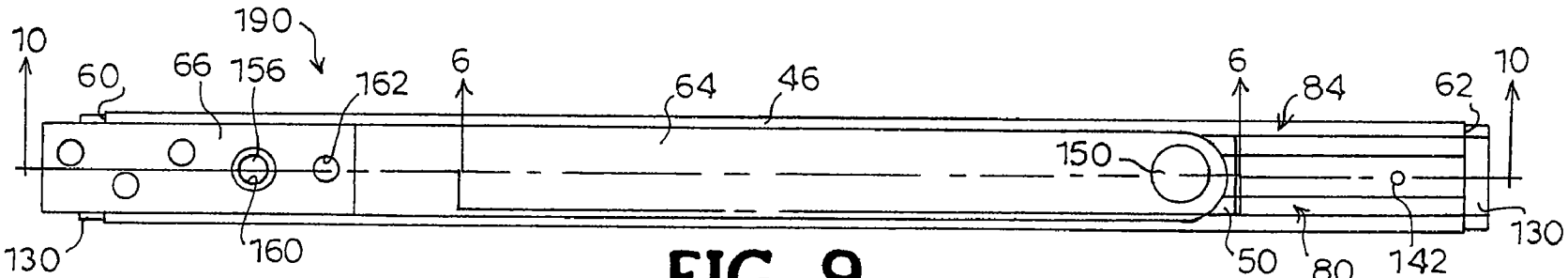
FIG. 9 is a top plan view of another embodiment of a door holder assembly in the surface mounted configuration of the door motion controller assembly of FIG. 1.
Figure 10:
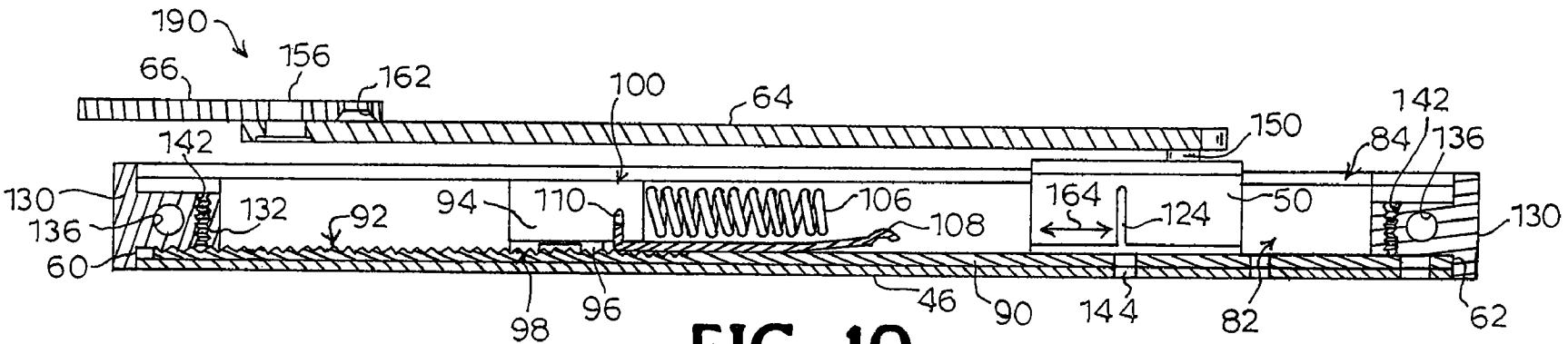
FIG. 10 is a partial section view of the door holder assembly of FIG. 9 taken along line 10-10 of FIG. 9.

FIGS. 9 and 10 are top plan and partial section views, respectively, that show a surface mounted door holder 190 in the configuration of the door motion controller 70 of FIG. 2 in other than a hold-open position. As discussed above with respect to FIG. 3, the surface mounted door holder embodiment 190 differs from the concealed door holder 74 in the treatment of the end of the track assembly 42 for mounting to the door 48. From the concealed door holder orientation, the end blocks 130 are rotated ninety degrees such that the openings 134 through the end blocks 130 and openings 140 in the sides of the channel 46 align as shown in FIG. 10. The other components and operation of the surface mounted door holder embodiment 190 are the same as the concealed holder embodiment 74 and are as appears in FIGS. 6 (adjustable configuration), 7 (operating position), and 8 (hold-open position).

Figure 11:
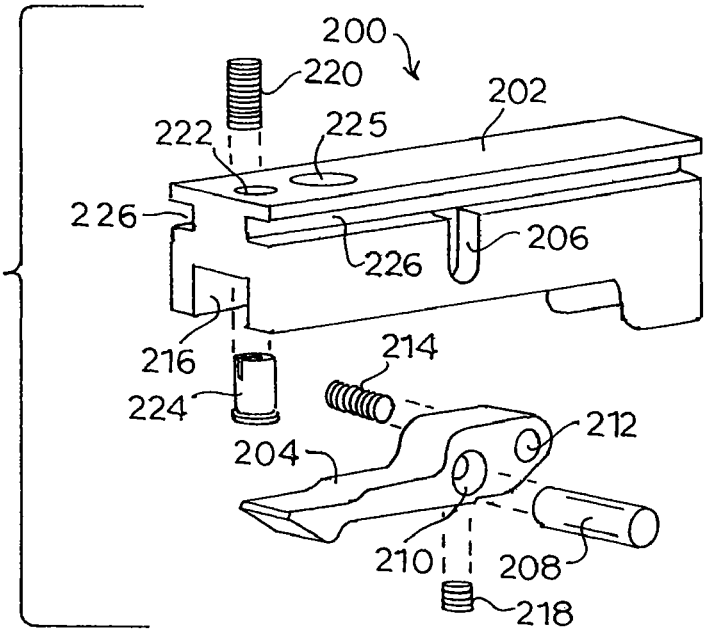
FIG. 11 is an exploded view of a second embodiment of a slide mechanism in addition to the one shown in FIGS. 3-10, according to the present invention.

FIG. 11 shows a second embodiment of a sliding mechanism 200 that may be substituted for the sliding mechanism 120 shown in FIG. 3. The sliding mechanism 200 shown in FIG. 11 includes a sliding piece 202 and a latch 204. The sliding piece 202 is generally U shaped, including a base portion and two downwardly depending leg portions. An opening 225 in the base portion accepts the cam pivot 150 from the arm 64. The upper edges of the slide piece 202 have external longitudinal grooves 226 that slidingly accept the lips 84 of the channel 46, along which the slide piece 202 rides. The latch 204 is received the leg portions of the sliding piece 202. A pivot pin 208 is placed in a U-shaped slot in the sliding piece 202 and passes through an opening 210 in the latch 204 for pivotally holding the latch 204 in place. The U-shaped slot extends across the width of the sliding piece 202. A threaded transverse opening 212 in the latch 204 holds a set screw 214 which provides a tight fit for the latch 204 within the channel 216 of the slide piece 202. A vertically oriented second set screw 218 extends into an opening (not visible) in the lower surface of the latch 204 and interferes with the pivot pin opening 210 such that the set screw 218 holds the pivot pin 208 in place. A third set screw 220 passes through a vertical opening 222 in the base portion of the slide piece 202 and is received in a hollow, threaded sleeve 224 disposed in the channel 216 of the slide piece 202. The end of the third set screw 220, which extends through the sleeve 224, may selectively contact the free end of the latch 204.

Figure 12:
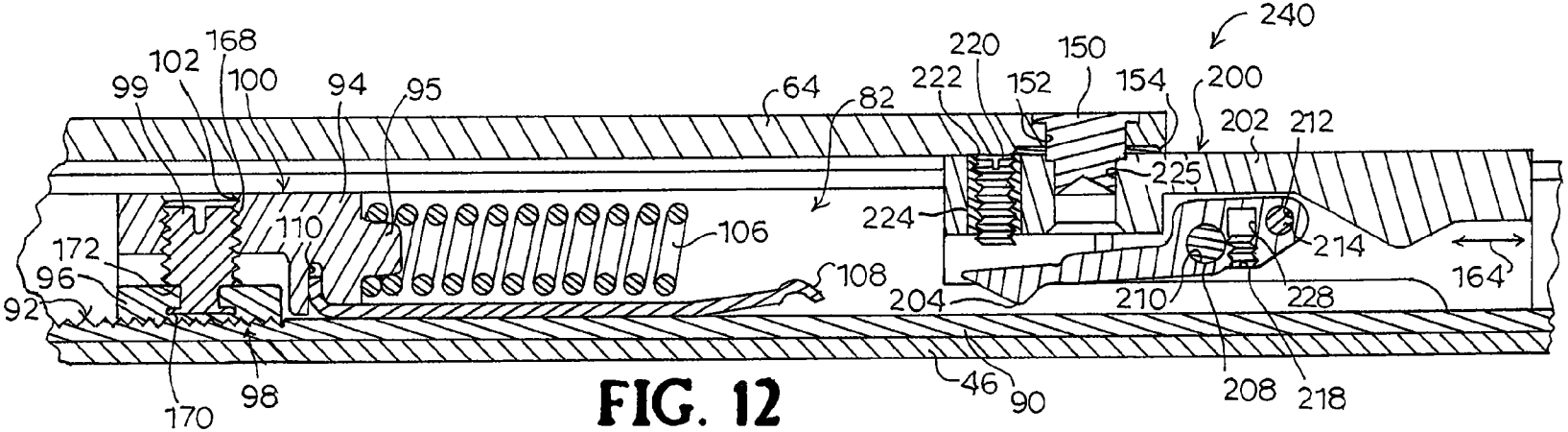
FIG. 12 is a section view of a door holder assembly in a first position including the slide mechanism of FIG. 11.
Figure 13:
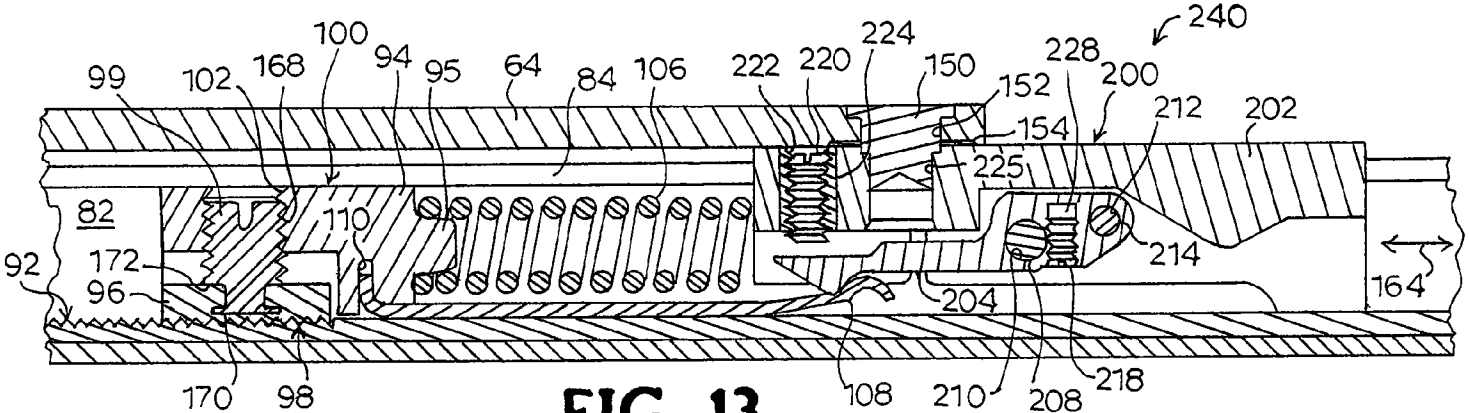
FIG. 13 is a section view of the door holder assembly of FIG. 12 in a second position.

FIGS. 12 and 13 show an embodiment of a door holder 240 including the sliding mechanism 200 with the latch 204 shown in FIG. 11. FIG. 12 shows the door holder 240 in an operating position where the door 48 is not held open. The adjustable stop 100, coil spring 106, and lock clip 108 may be the same as in the door holders 74, 190 of FIGS. 3-10. The sliding mechanism 200 is oriented such that the latch 204 will engage the lock clip 108 when the sliding mechanism 200 slides toward the adjustable stop 100. The latch 204 and pivot pin 208 the axis of the pivot pin 208 rotate around. When the free end of the latch 204 contacts the lock clip 108, the free end of the latch 204 deflects upward until the free end contacts the third set screw 220. The vertical position of set screw 220 controls the height of the free end of the latch 204, and accordingly controls the force required to deflect the lock clip 108 downwardly so that the free end of the latch 204 may pass over the lock clip 108. FIG. 13 shows the door holder 240 in the hold-open position, with the latch 204 and lock clip 108 engaged.

Figure 14:
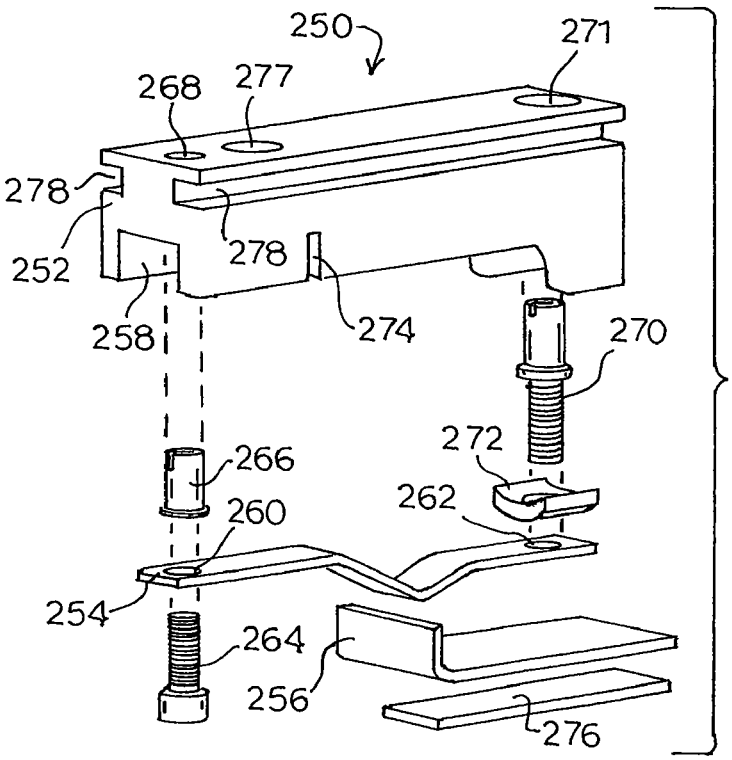
FIG. 14 is an exploded view of a third embodiment of a slide mechanism according to the present invention.

FIG. 14 shows a third embodiment of a sliding mechanism 250 that may be substituted for the first and second embodiments of sliding mechanisms 120, 200 shown in FIGS. 3 and 11. This sliding mechanism 250 is a friction assembly that slows the movement of the door 48, rather than holding the door 48 open. The sliding mechanism 250 includes a slide piece 252, a friction spring 254, and a friction plate 256. The friction spring 254 has openings 260, 262 at each end of the spring 254 is mounted to the slide piece 252 in the slide piece channel 258 using a socket head screw 264 and an adjustment screw 270. The third slidepiece 252 is nearly identical to the second slide piece 200. The socket head screw 264 passes through the opening 260 at one end of the spring 254, and then through a sleeve 266 and into an opening 268 in the slide piece 252. At the other end of the spring 254, the adjustment screw 270 passes through the opening 262, and has a slotted end that may be accessed through an opening 271 in the base portion of the slide piece 252. An adjustment nut 272 is on the adjustment screw 270. Beneath the friction spring 254, the bent friction plate 256 has a flange at one end that is placed in a slot 274 in the slide piece 252. A friction pad 276 is mounted to the underside of the friction plate 256. This mounting may be done with adhesive or other means as selected by one of ordinary skill in the art. The pad 276 may be, for example, a relatively hard plastic such as polytetrafluoroethylene (PTFE, or Teflon, a registered trademark of E.I. du Pont de Nemours and Company), or other materials as selected by one of ordinary skill in the art.

Figure 15:
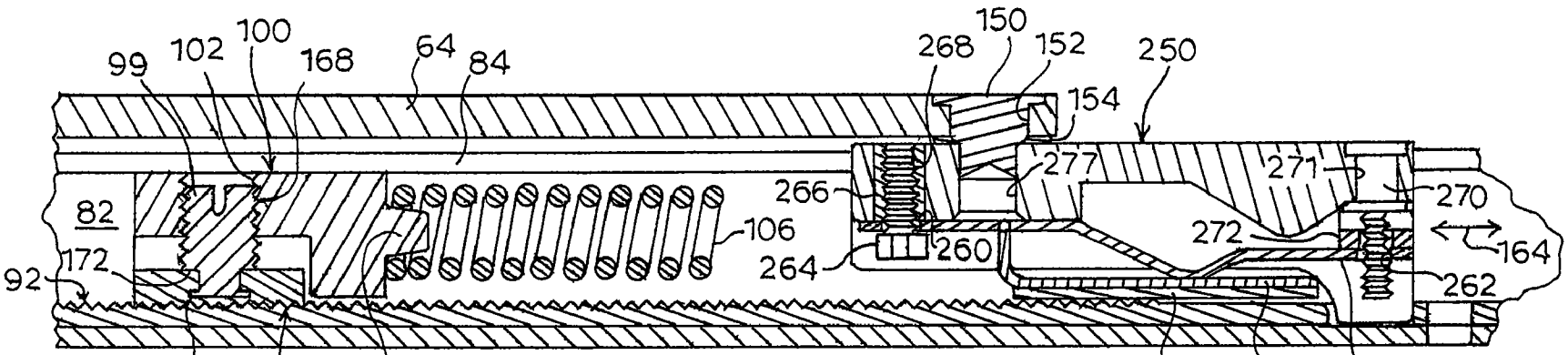
FIG. 15 is a section view of an embodiment of a door motion controller assembly that is a door slower assembly including the slide mechanism of FIG. 14, according to the present invention.

FIG. 15 shows an embodiment of a door motion controller that is a motion slowing device or door slower 290 that includes the friction assembly sliding mechanism 250. In the position shown in FIG. 15, the door 48 is less than fully opened. The lock clip 108, however, may be omitted since the hold-open function is not performed by this embodiment. With respect to the sliding mechanism 250, the friction pad 276 rubs along the teeth 92 of the track 90 as the sliding mechanism 250 slides 164 along the track 90. The friction between the friction pad 276 and the teeth 92 causes the door 48 to slow. The sliding mechanism moves to the left until it compresses the spring 106 and then may move to the right to close. Adjusting the force the friction pad 276 applies to the teeth 92 is accomplished by tightening or loosening the friction adjustment screw 270 which changes the force applied to the friction spring 254. The greater the force, the greater the friction, and the slower the door 48 will move. Specific embodiments of an invention are described herein. One of ordinary skill in the door hardware arts will recognize that the invention has other applications in other environments. In fact, many embodiments and implementations are possible. For example, the door motion controller could be applied to articles other than doors, such as windows or furniture, for example, couches or tables with moving parts. In addition, the recitation "means for" is intended to evoke a means-plus-function reading of an element in a claim, whereas, any elements that do not specifically use the recitation "means for," are not intended to be read as means-plus-function elements, even if they otherwise include the word "means." The following claims are in no way intended to limit the scope of the invention to the specific embodiments described.

What is claimed is:

1. A motion controller assembly for a door, the door including a first major surface and a second major surface, and a hinged vertical edge, a free vertical edge, a top edge, and a bottom edge, the edges between and interconnecting the first major surface and the second major surface, the motion controller assembly comprising:

an elongated channel member having a longitudinal axis and including a web and two side walls extending in the same direction from the web and defining an elongated channel, and further including teeth extending from a side of the web and into the channel, the elongated channel member adapted to be mounted to the door; and a gripping member including:

a housing slidably disposed in the channel member and having a threaded opening opposite the channel member teeth;

a toothed portion that is movably disposed in the housing and includes a toothed surface; and a pin including a first threaded end engaging the threaded opening of the housing and including a second end rotatably mounted to the toothed portion, wherein the toothed surface opposes the toothed side of the web, wherein the toothed portion has a first position spaced from the channel member teeth such that the gripping member is movable in the channel member, and a second position where the teeth of the toothed portion engage the channel member teeth such that the gripping member is fixed relative to the channel member, and wherein the pin is movable in the opening for moving the toothed portion between the first and second positions.

2. The motion controller assembly of claim 1, wherein the channel member is adapted to be mounted to the first major surface of the door.

3. The motion controller assembly of claim 1, wherein the channel member is adapted to be mounted to the door in a recess along the top edge.

4. The motion controller of claim 1, wherein the channel member further comprises an elongated track mounted to the web of the channel member between the two side walls, and the teeth of the channel member are disposed on the track.

5. The motion controller assembly of claim 1, wherein the channel member further comprises a lip along each side wall perpendicular to each side wall, the lips extending towards each other.

6. The motion controller assembly of claim 5, wherein when the gripping member is in the second position and the pin is advanced the housing is moved against the lips.

7. The motion controller assembly of claim 1, wherein the gripping member further comprises an elongated clip mounted to the gripping member and extending along the longitudinal axis of the channel member, the elongated clip including a deformed end.

8. The motion controller assembly of claim 7, further comprising a slide piece slidingly disposed in the channel member and spaced from the gripping member.

9. The motion controller assembly of claim 8, further comprising a coil spring mounted to the gripping member and extending along the longitudinal axis towards the slide piece, the axial length of the coil spring being less than the axial length of the elongated clip, wherein the slide piece engages the coil spring when the slide piece at least in part passes the deformed end.

10. The motion controller assembly of claim 8, further comprising:

a mounting plate adapted to be mounted to a door frame; and an arm having a first end pivotally mounted to the slide piece and a second end pivotally mounted to the mounting plate.

11. The motion controller assembly of claim 8, further comprising a spring clip mounted to the slide piece, wherein when the slide piece slides towards the housing, the spring clip engages the deformed end of the elongated clip.

12. The motion controller assembly of claim 11, wherein the slide piece has a threaded opening and further comprising a set screw including a threaded portion and extending through and engaging the threaded opening in the slide piece, such that when tightened the set screw urges the spring clip towards the track and increases the tightness of the engagement between the spring clip and the elongated clip.

13. The motion controller assembly of claim 8, further comprising a latch pivotally mounted to the slide piece, wherein when the latch slides towards the housing, the latch and the elongated clip releasably engage.

14. The motion controller assembly of claim 13, wherein the slide piece has a threaded opening, and includes a set screw disposed at least partially within the opening, wherein when the set screw extends through the opening, the set screw may limit the pivoting of the latch.

15. The motion controller assembly of claim 8, further comprising a friction member mounted to the slide piece, wherein a major surface of the friction member contacts the channel member teeth.

16. The motion controller assembly of claim 15, wherein the friction member comprises a friction plate mounted to the slide piece and a friction pad mounted to the friction plate such that the major surface of the friction pad contacts the channel member teeth.

17. A motion controller assembly for a door, comprising:

an elongated channel member having a longitudinal axis and including a web and two side walls extending in the same direction from the web and defining an elongated channel, and further including teeth extending from a side of the web and into the channel, the elongated channel member adapted to be mounted to the door;

a gripping member slidably disposed in the channel member and including:

a housing slidably disposed in the channel member and having a threaded opening opposite the channel member teeth;

a toothed portion that is movably disposed in the housing with teeth that oppose the channel member teeth; and a pin including a first threaded end engaging the threaded opening of the housing and including a second end rotatably mounted to the toothed portion; and an elongated clip mounted to the gripping member and extending along the longitudinal axis, the elongated clip including a deformed end;

a slide piece slidably disposed in the channel member and spaced from the housing; and a spring clip or a latch mounted to the slide piece, wherein the toothed portion has a first position spaced from the channel member teeth such that the gripping member is movable in the channel member when the pin is retracted, and a second position where the teeth of the toothed portion engage the channel member teeth such that the gripping member is fixed relative to the channel member when the pin is advanced, and wherein when the spring clip or latch slides towards the gripping member, the spring clip or latch engages the deformed end of the elongated clip.

18. A motion controller assembly for a door, comprising:

an elongated channel member having a longitudinal axis and including a web and two side walls extending in the same direction from the web and defining an elongated channel, and further including teeth extending from a side of the web and into the channel, the elongated channel member adapted to be mounted to the door;

a gripping member slidably disposed in the channel member and including:

a housing slidably disposed in the channel member and having a threaded opening opposite the channel member teeth;

a toothed portion that is movably disposed in the housing with teeth that oppose the channel member teeth; and a pin including a first threaded end engaging the threaded opening of the housing and including a second end rotatably mounted to the toothed portion; and an elongated clip mounted to the gripping member and extending along the longitudinal axis, the elongated clip including a deformed end;

a slide piece slidably disposed in the channel member, spaced from the housing, and having a threaded opening; and a spring clip mounted to the slide piece; and a set screw extending through and engaging the threaded opening in the slide piece, wherein when the slide piece slides towards the housing, the spring clip and the deformed end of the elongated clip releasably engage, and wherein when advanced the set screw urges the spring clip towards the web and increases the tightness of the engagement between the spring clip and the deformed end of the elongated clip.

19. A motion controller assembly for a door, comprising:

an elongated channel member having a longitudinal axis and including a web and two side walls extending in the same direction from the web and defining an elongated channel, and further including teeth extending from a side of the web and into the channel, the elongated channel member adapted to be mounted to the door;

a gripping member slidably disposed in the channel member and including:

a housing slidably disposed in the channel member and having a threaded opening opposite the channel member teeth;

a toothed portion that is movably disposed in the housing with teeth that oppose the channel member teeth; and a pin including a first threaded end engaging the threaded opening of the housing and including a second end rotatably mounted to the toothed portion; and an elongated clip mounted to the gripping member and extending along the longitudinal axis, the elongated clip including a deformed end;

a slide piece slidably disposed in the channel member, spaced from the housing, and having a threaded opening; and a latch pivotally mounted to the slide piece; and a set screw extending through and engaging the threaded opening in the slide piece, wherein when the slide piece slides towards the housing, the latch and the elongated clip releasably engage, and wherein when advanced the set screw limits the pivoting of the latch and controls the tightness of the engagement between the latch and the deformed end of the elongated clip.

20. A motion controller assembly for a door, comprising:

an elongated channel member having a longitudinal axis and including a web and two side walls extending in the same direction from the web and defining an elongated channel, and further including teeth extending from a side of the web and into the channel, the elongated channel member adapted to be mounted to the door;

a gripping member slidably disposed in the channel member and including:

a housing slidably disposed in the channel member and having a threaded opening opposite the channel member teeth;

a toothed portion that is movably disposed in the housing with teeth that oppose the channel member teeth; and a pin including a first threaded end engaging the threaded opening of the housing and including a second end rotatably mounted to the toothed portion; and an elongated clip mounted to the gripping member and extending along the longitudinal axis, the elongated clip including a deformed end;

a slide piece slidably disposed in the channel member and spaced from the housing; and a friction member mounted to the slide piece, wherein the toothed portion has a first position spaced from the channel member teeth such that the gripping member is movable in the channel member when the pin is retracted, and a second position where the teeth of the toothed portion engage the channel member teeth such that the gripping member is fixed relative to the channel member when the pin is advanced, and wherein a major surface of the friction member contacts the channel member teeth.

21. A door assembly, comprising:

a door; and a motion controller assembly mounted to the door, comprising:

an elongated channel member having a longitudinal axis and including a web and two side walls extending in the same direction from the web and defining an elongated channel, and further including teeth extending from a side of the web and into the channel, the elongated channel member adapted to be mounted to the door; and a gripping member including:

a housing slidably disposed in the channel member and having a threaded opening opposite the channel member teeth;

a toothed portion that is movably disposed in the housing and includes a toothed surface; and a pin including a first threaded end engaging the threaded opening of the housing and including a second end rotatably mounted to the toothed portion, wherein the toothed surface opposes the toothed side of the web, wherein the toothed portion has a first position spaced from the channel member teeth such that the gripping member is movable in the channel member, and a second position where the teeth of the toothed portion engage the channel member teeth such that the gripping member is fixed relative to the channel member, and wherein the pin is movable in the opening for moving the toothed portion between the first and second positions.

22. The door assembly of claim 21, wherein the channel member further comprises a lip along each side wall perpendicular to each side wall, the lips extending towards each other.

23. The door assembly of claim 22, wherein when the gripping member is in the second position and the pin is advanced the housing is moved against the lips.

24. A method of making a motion controller assembly for a door, the method comprising:

providing an elongated channel member having a longitudinal axis and including a web and two side walls extending in the same direction from the web and defining an elongated channel, and further including teeth extending from a side of the web and into the channel, the elongated channel member adapted to be mounted to the door; and providing a gripping member including a toothed portion and a housing in which the toothed portion is at least partially disposed; and slidably disposing the gripping member in the channel member such that the toothed portion of the gripping member opposes the channel member teeth.

25. A method of installing a motion controller assembly for a door, the method comprising:

mounting a track assembly to the door, the track assembly including:

an elongated channel member having a longitudinal axis and including a web and two side walls extending in the same direction from the web and defining an elongated channel, and further including teeth extending from a side of the web and into the channel, the elongated channel member adapted to be mounted to the door; and a gripping member slidably disposed in the channel member and including:

a housing slidably disposed in the channel member and having a threaded opening opposite the channel member teeth;

a toothed portion that is movably disposed in the housing with teeth that oppose the channel member teeth; and a pin including a first threaded end engaging the threaded opening of the housing and including a second end rotatably mounted to the toothed portion;

adjusting the position of the gripping member by sliding the gripping member along the channel member;

advancing the pin to cause the teeth of the gripping member to engage the channel member teeth, fixing the position of the housing.

26. A method of installing a holder assembly for a door, the method comprising:

mounting a track assembly to the door, the track assembly including:

an elongated channel member having a longitudinal axis and including a web and two side walls extending in the same direction from the web;

a housing slidably disposed in the channel member;

an elongated clip mounted to the housing and extending along the longitudinal axis, the elongated clip including a deformed end;

a slide piece movably disposed in the channel member, spaced from the housing, and having a threaded opening;

a spring clip mounted to the slide piece; and a set screw extending through and engaging the threaded opening in the slide piece; and advancing the set screw to urge the spring clip towards the web, increasing the tightness of the engagement between the spring clip and the deformed end of the elongated clip.

27. A method of installing a holder assembly for a door, the method comprising:

mounting a track assembly to the door, the track assembly including:

an elongated channel member having a longitudinal axis and including a web and two side walls extending in the same direction from the web;

a housing slidably disposed in the channel member;

an elongated clip mounted to the housing and extending along the longitudinal axis, the elongated clip including a deformed end;

a slide piece slidingly disposed in the channel member, spaced from the housing, and having a threaded opening;

a latch pivotally mounted to the slide piece; and a set screw extending through and engaging the threaded opening in the slide piece; and advancing the set screw to limit the pivoting of the latch and control the tightness of the engagement between the latch and the deformed end of the elongated clip.

28. A motion controller assembly for a door, the door including a first major surface and a second major surface, and a hinged vertical edge, a free vertical edge, a top edge, and a bottom edge, the edges between and interconnecting the first major surface and the second major surface, the motion controller assembly comprising:

an elongated channel member having a longitudinal axis and including a web and two side walls extending in the same direction from the web and defining an elongated channel, and further including teeth extending from a side of the web and into the channel, the elongated channel member adapted to be mounted to the door;

means for gripping the channel member, the gripping means including:

a toothed surface that opposes the toothed side of the web;

means for moving the toothed surface between a first position spaced from the channel member teeth such that the gripping means is movable in the channel member, and a second position where the teeth of the toothed surface engage the channel member teeth such that the gripping means is fixed relative to the channel member.

* * * * *